US006058686A

United States Patent [19]

Wheeler

[11] Patent Number: 6,058,686

[45] Date of Patent: May 9, 2000

[54] EQUINE RESTRAINT SYSTEM

[76] Inventor: Raymond C. Wheeler, Rte. 2, Box 26A, Ellendale, Minn. 56026

[21] Appl. No.: 09/177,891

[22] Filed: Oct. 23, 1998

Related U.S. Application Data

[63] Continuation of application No. PCT/US96/15095, Sep. 20, 1996.

[60] Provisional application No. 60/016,636, Apr. 25, 1996.

[51] Int. Cl.[7] ..... B68B 1/00

[52] U.S. Cl. ..... 54/71; 54/6.1

[58] Field of Search ..... 54/6.1, 24, 71; 119/800

[56] References Cited

U.S. PATENT DOCUMENTS

| | | | |
|---|---|---|---|
| 437,867 | 10/1890 | O'Connor | 54/6.1 |
| 815,424 | 3/1906 | Halliburton | 54/24 |
| 843,689 | 2/1907 | McClintock | 54/24 |
| 985,642 | 2/1911 | Tallman | 54/24 |
| 1,209,724 | 12/1916 | Koepke | 54/6.1 |
| 2,804,741 | 9/1957 | Cheesebro | 54/24 X |
| 3,657,863 | 4/1972 | Blair . | |

*Primary Examiner*—Robert P. Swiatek
*Attorney, Agent, or Firm*—Richard C. Litman

[57] ABSTRACT

An equine restraint system which allows a single person to control a horse while performing tasks such as leading, holding, saddling or loading of the horse. The restraint system has a portion that fits behind the horse's ears and a portion that fits under the horse's upper lip. The restraint system has a single cord which can be pulled to simultaneously apply pressure behind the horse's ears and under the horse's upper lip.

10 Claims, 2 Drawing Sheets

EQUINE RESTRAINT SYSTEM

CROSS-REFERENCE TO RELATED APPLICATIONS

This application claims the benefit of the priority of International Patent Application Number PCT/US96/15095, filed on Sep. 20, 1996, which claims the benefit of the priority of U.S. Provisional Application Ser. No. 60/016,636, filed on Apr. 25, 1996.

BACKGROUND OF THE INVENTION

1. Field of the Invention

The present invention relates to a restraint system for controlling the behavior of a horse while performing activities that may involve some discomfort to the horse.

2. Description of the Prior Art

Frequently it is necessary to perform operations on a horse that involve some discomfort to the horse. Such operations include saddling, vaccinating, drawing blood samples, shoeing, etc. During such operations the horse may become agitated and may react violently causing injury to itself and to bystanders. To date devices known as "twitches" have been used to restrain a horse while performing activities that may involve some discomfort to the horse. These conventional devices require at least two people to operate the devices successfully, unlike the present invention which can be operated by one person. In addition to the conventional twitches, other devices have been proposed in the prior art which put pressure on the regions behind a horse's ears and under the horse's upper lip to control the horse's behavior. However, none of the prior art devices provide the degree of adjustability and safety of the present invention. Further, none have the unique structural features of the present invention.

U.S. Pat. No. 233,631, issued to Dennis Magner on Oct. 26, 1880, shows a bridle having a bit. A chain is connected to the bit which fits under the upper lip of the horse. The Magner device does not allow pressure to be applied to the region under the horse's upper lip independently of the pressure applied to the corners of the horse's mouth by the bit.

U.S. Pat. No. 437,867, issued to Peter O'Connor on Oct. 7, 1890, shows a restraint device that puts pressure on the region of the horse's upper lip. The O'Connor device does not use a single continuous cord as in the present invention. Further, the O'Connor device lacks the double barrel sleeve and the double pulley of the present invention.

U.S. Pat. No. 474,739, issued to Gibson R. Hollingsworth on May 10, 1892, shows a bridle for applying pressure to a horse's mouth by pulling on a single cord. The Hollingsworth device does not apply pressure to the region under the horse's upper lip.

U.S. Pat. No. 751,006, issued to Henry H. Poe on Feb. 2, 1904, shows a bridle having a system of pulleys for controlling the application of pressure to a bit. The Poe device does not apply pressure to the region under the horse's upper lip.

U.S. Pat. No. 804,700, issued to August L. Bethe on Nov. 14, 1905, shows a pivoting bit for a horse. The Bethe device does not apply pressure to the region under the horse's upper lip.

U.S. Pat. No. 1,351,620, issued to Samuel C. Canter on Aug. 31, 1920, shows a combination bridle and halter. The Canter device does not apply pressure to the region under the horse's upper lip.

U.S. Pat. No. 4,941,312, issued to Ralph N. Old, Sr. on Jul. 17, 1990, shows a bit having a chain that passes under the horse's lower jaw. The Old device does not apply pressure to the region under the horse's upper lip.

Swedish Patent Document Number 3798, by K. J. Petterson dated Sep. 14, 1892, shows a bridle having a bit. A chain is connected to the bit which fits under the upper lip of the horse. The Petterson device does not allow pressure to be applied to the region under the horse's upper lip independently of the pressure applied to the corners of the horse's mouth by the bit.

French Patent Document Number 0 018 915, by Eric Le Tixerant dated Nov. 12, 1980, shows a bridle having pulleys for controlling the application of pressure to a bit. The Le Tixerant device does not apply pressure to the region under the horse's upper lip.

None of the above inventions and patents, taken either singly or in combination, is seen to describe the instant invention as claimed.

SUMMARY OF THE INVENTION

The present invention is directed to an equine restraint system which can be operated by a single person while allowing that person to carry out tasks such as leading, holding, saddling, and loading of the horse. The restraint system of the present invention has a portion that fits behind the horse's ears and a portion that fits under the horse's upper lip. The restraint system of the present invention has a single cord which can be pulled to simultaneously apply pressure behind the horse's ears and under the horse's upper lip. Application of pressure to these areas has a calming affect on the horse, allowing various activities to be performed on the horse.

Accordingly, it is a principal object of the invention to provide an equine restraint system which simultaneously puts pressure on the nerve centers behind a horse's ears and under the horse's upper lip.

It is another object of the invention to provide an equine restraint system that can be operated by a single person.

It is a further object of the invention to provide an equine restraint system that can be adjusted in size easily.

Still another object of the invention is to provide an equine restraint system which reduces the possibility of injury to the horse and/or bystanders.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
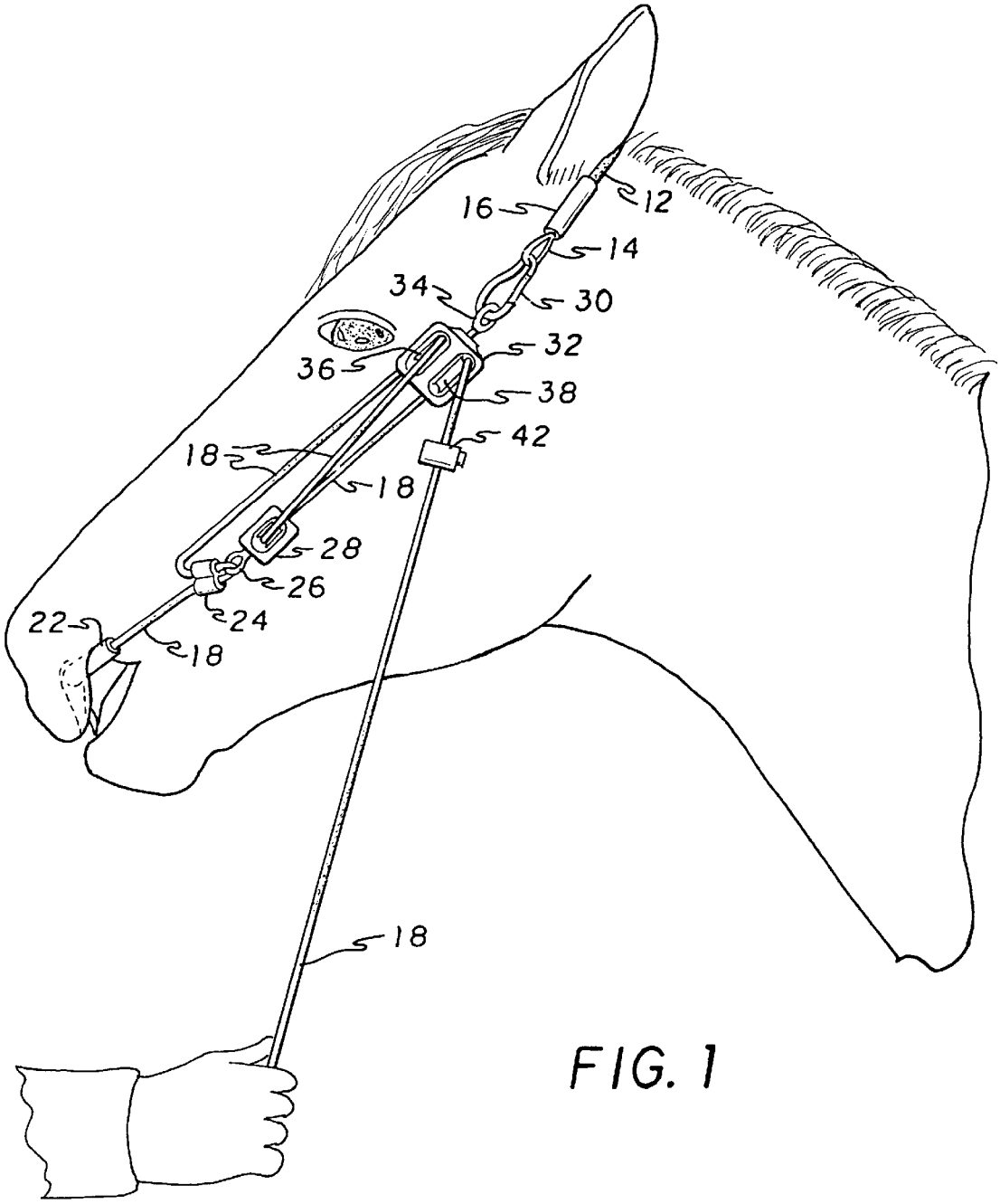
FIG. 1 is an environmental view showing the equine restraint system of the present invention in position on a horse's head.
Figure 2:
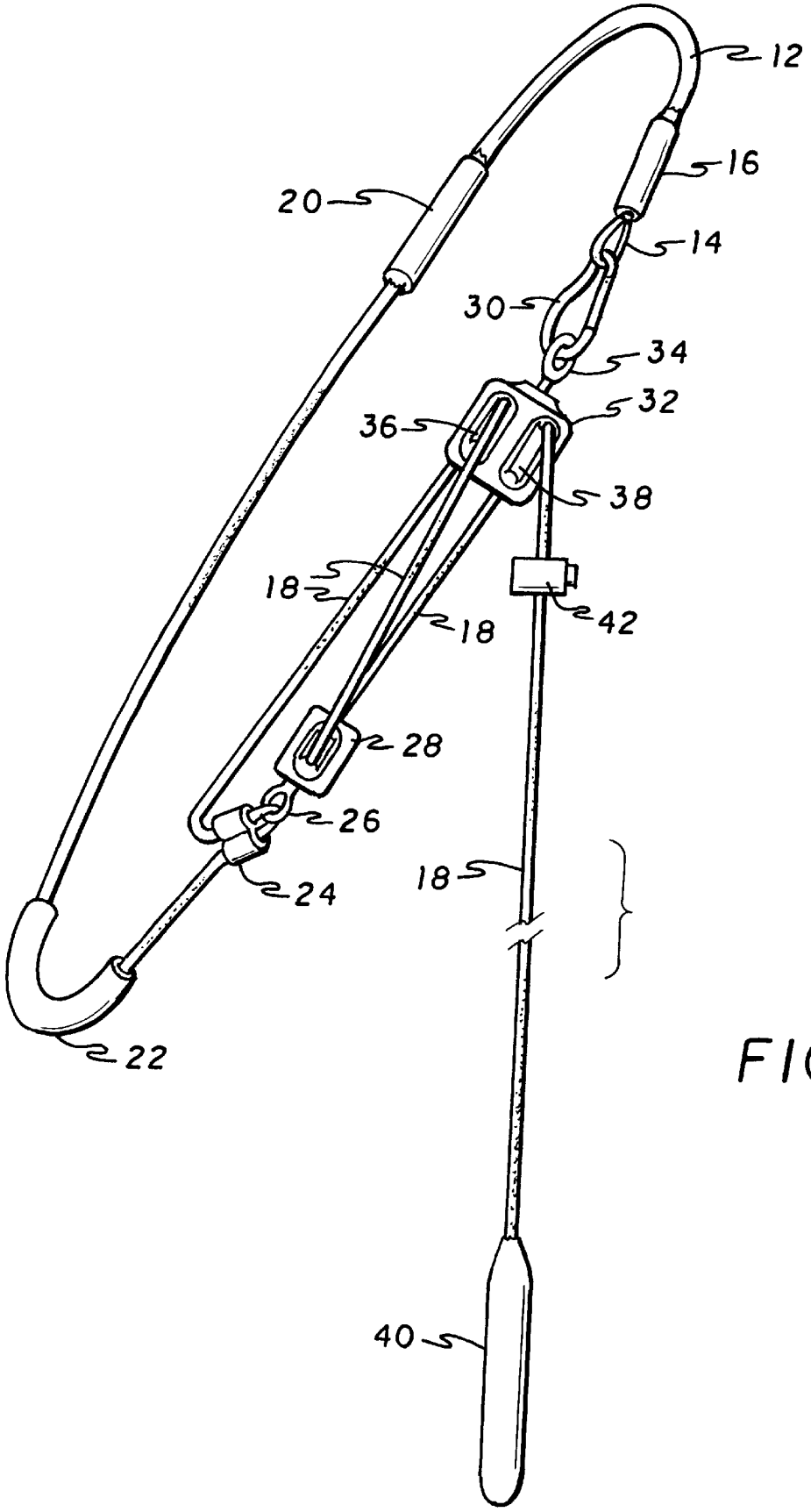
FIG. 2 is a perspective view showing details of the equine restraint system of the present invention.

Referring to FIGS. 1 and 2, the present invention is an equine restraint system 10 used for calming a horse while performing various tasks involving the horse. These tasks include, for example, breeding, drawing blood, hot walking, ponying, tubing, clipping, driving, loading, saddling in paddock, vaccinations, deworming, floating teeth, medicating, shoeing, and wound doctoring.

The restraint 10 includes a plastic coated cable 12 which is intended to rest on the poll of the horse's head (the area just behind the ears). One end of the cable 12 is formed into a loop 14 and crimped back on itself. The region of the crimp, adjacent loop 14, is covered by a heat shrinkable plastic tube 16. The tube 16 covers any sharp edges or projections that may be a source of irritation to the horse. The other end of the cable 12 is attached to the end of a cord 18 by crimping or any other well known means. Again, the attachment of the cable 12 to the cord 18 is covered by a heat shrinkable plastic tube 20 in order to cover any sharp edges or projections that may be a source of irritation to the horse.

The cord 18 passes through clear plastic tubing 22 whose function is explained below. After passing through the plastic tubing 22, the cord 18 passes through a first barrel of a double barrel aluminum sleeve 24. After passing through the first barrel of the double barrel sleeve 24, the cord 18 passes through the eye of a swivel 26 attached to a single pulley 28. The cord 18 then passes back through the second barrel of the sleeve 24.

Attached to the loop 14 is a snap hook 30 having a pivoting latch. The snap hook 30 releasably attaches a double pulley 32 to the loop 14. The double pulley 32 has a swivel 34 through which the snap hook 30 passes. Also, the double pulley 32 has a first pulley 36 and a second pulley 38 which are positioned side by side and rotate about the same axis.

After passing through the second barrel of the sleeve 24, the cord 18 passes around the first pulley 36 of the double pulley 32. Then the cord 18 passes around the single pulley 28, after which the cord 18 continues back toward the double pulley 32. Then the cord 18 passes around the second pulley 38 of the double pulley 32, after which the cord 18 continues for a predetermined length until finally terminating in the handle 40.

A spring loaded, movable cord stop 42 is provided on the portion of the chord 18 extending between the double pulley 32 and the handle 40. The cord stop 42 is of the type having a button slidably supported by the bore of an outer sleeve. The button has a hole therethrough which can be made to register with a pair of holes in the outer sleeve of the stop 42, when the button is properly positioned relative to the outer sleeve of the stop 42. A spring housed within the outer sleeve of the stop 42, tends to push the button outward thus causing the hole through the button to go out of alignment with the holes in the outer sleeve. With the cord 18 passing through both the hole through the button and the holes in the outer sleeve of stop 42, spring pressure pushes the hole through the button out of alignment with the holes in the outer sleeve, thus pinching the cord 18 between the button and the outer sleeve. The cord stop 42 is thus frictionally fixed to the cord 18. To reposition the cord stop 42, the button is depressed bringing the hole through the button into alignment with the holes in the outer sleeve. This action releases the frictional force on the cord 18, allowing the cord stop 42 to be slidably moved along the cord 18. Once the cord stop 42 has reached the desired position on the cord 18, the button is released fixing the cord stop in the new position. The cord stop 42 is well known in the art and it is therefore not shown in detail in the accompanying illustrations.

The handle 40 is made from a piece of plastic tubing through which the cord 18 passes. After passing the cord 18 through the plastic tubing the end of the cord 18 is tied in a knot (not shown), thus preventing the plastic tubing from slipping off the cord 18. A piece of heat shrinkable tubing is then slipped over the plastic tubing and shrunk (not shown), thus fixing the plastic tubing at the end of the cord 18. This construction results in a light weight and relatively soft handle. The construction of the handle 40 is an important feature of the present invention, since a heavier and/or harder handle can cause injury to the horse or a bystander if the horse violently swings its head as horses are apt to do on occasion.

FIG. 1 shows the restraint system 10 in use. The restraint system 10 would ordinarily be shipped from the manufacturer, already adjusted to fit a normal sized horse. To mount the restraint 10 to the horse's head, the cord stop 42 must first be moved toward the handle 40 by depressing the button of the cord stop 42 and sliding the cord stop down toward the handle 40. This step will allow some slack in the restraint system 10 while placing the restraint system 10 on the horse's head.

At this time the user must ensure that the plastic tubing 22 is positioned as close as possible to the aluminum sleeve 24. When applying the restraint system 10 the user should always work from the horse's left side as when bridling. Next, the cable 12 is positioned over the horse's head just behind the ears. The user must then grasp the plastic tubing 22, with the left hand, and place the plastic tubing under the upper lip of the horse. The plastic tubing 22 prevents cuts and abrasions to the horse's gums and upper lip that may be caused by the cord 18.

While holding the plastic tubing 22 in position under the horse's upper lip, the user must then begin to slowly pull on the handle 40 in order to take any slack out of the restraint system 10. Once the slack has been taken out of the restraint system 10 and the desired amount of pressure is being applied to the areas under the horse's upper lip and behind the horse's ears, the cord stop 42 is slidingly moved along the cord 18 until the cord stop is as close to the double pulley 32 as possible. This step of sliding the stop 42 as close as possible to the double pulley 32, will ensure that the desired mount of pressure is continuously applied to the areas under the horse's upper lip and behind the horse's ears, even when the handle 40 is released. The mounting of the restraint system 10 to the horse's head is now completed.

The restraint system 10 should fit the horse's head snugly. Should it become necessary to apply more pressure to the areas under the horse's upper lip and behind the horse's ears in order to control the horse, the applied pressure can be increased simply by pulling on the handle 40 and sliding the stop 42 closer to the double pulley 32. To take off the restraint system 10, the cord stop 42 is slidingly moved toward the handle 40, thus loosening the restraint system 10 and allowing the cable 12 to be moved over the ears which in turn allows the restraint system 10 to slide off of the horse's head. If the horse is extra sensitive around the ears or head, the restraint system 10 is designed to allow an alternative method of mounting. This alternative method is performed by first opening the snap hook 30 in order to open up the restraint system 10. The restraint system 10 is then placed around the horse's neck and the snap hook 30 is reattached to the loop 14. Next, cable 12 is positioned behind the ears while the plastic tubing 22 is placed under the upper lip of the horse. The restraint system 10 is then secured to the horse's head in the same manner as was described previously.

The restraint system 10 allows just one person to restrain the equine athlete while at the same time allowing the same person to lead, hold, saddle, or load the horse. Conventional twitches require at least two people to allow the performance of the same tasks. When in place, the restraint system 10 applies pressure to the nerves under the upper lip and behind the poll (top of the head behind the ears) of the horse's head. Because of its unique dual pressure point design, the restraint system 10 applies steady pressure to these two vital sensory nerve centers and can be used in punishing and rewarding the horse instantly at the time of a particular behavior. With this pressure applied, the restraint system 10 distracts the horse's attention from other parts of its body that are being worked on. Evidence shows that endorphin is released by twitch pressure application on sensory nerve centers. Endorphin is a narcotic-like substance produced in and released from the nervous system and the endorphin blocks nerve impulses signalling pain from other parts of the body allowing the horse to relax. Because of its unique design, the restraint system 10 allows the appropriate nerve centers to be stimulated by only one person, not the usual two people as with conventional twitches. Once put on, the restraint system 10 is securely held in place and will not fall off.

Adjusting the size of the restraint system 10 is also very simple to accomplish. To shorten the size of the restraint 10, the sleeve 24 is moved away from the single pulley 28 leaving excess cord in the loop of cord passing through the eye of the swivel 26. The desired amount of the excess cord is taken up by pulling cord 18 through the second barrel of the sleeve 24. The sleeve 24 is then again pushed snugly against the single pulley 28.

To enlarge the restraint system 10, the cord 18 is pulled through the second barrel of the sleeve 24 from the side of the sleeve 24 closer to the single pulley swivel 26. Then the slack is taken up by pulling cord 18 through the first barrel of the sleeve 24 from the plastic tubing side of the sleeve 24. This action simultaneously brings the sleeve 24 back snugly against the single pulley 28.

It is to be understood that the present invention is not limited to the sole embodiment described above, but encompasses any and all embodiments within the scope of the following claims.

I claim:

1. An equine restraint system comprising:

a cable having a first end and a second end;

a cord having a first end and a second end;

a double pulley having a first pulley and a second pulley, said second pulley being adjacent to and coaxial with said first pulley, said double pulley being attached to said cable proximate said second end of said cable;

a single pulley having an attachment eye; and a sleeve having a first barrel and a second barrel, said first end of said cable being attached to said first end of said cord, said cord being routed, in sequence, through said first barrel of said sleeve, said attachment eye of said single pulley, said second barrel of said sleeve, said first pulley of said double pulley, said single pulley, and said second pulley of said double pulley, leaving a portion of said cord extending from said second pulley of said double pulley and terminating at said second end of said cord;

whereby when said cable is positioned behind a horse's ears and when a portion of said cord located between said first end of said cable and said first barrel of said sleeve is placed under the horse's upper lip, pulling on a portion of said cord located between said second pulley of said double pulley and said second end of said cord causes pressure to be simultaneously applied to a region behind the horse's ears and a region under the horse's upper lip.

2. The equine restraint system according to claim 1, further including a handle provided at said second end of said chord.

3. The equine restraint system according to claim 1, further including a length of plastic tubing through which said cord passes before passing through said first barrel of said sleeve, said plastic tubing preventing cuts and abrasions to the horse's upper lip and gum.

4. The equine restraint system according to claim 1, wherein said double pulley is releasably attached to said cable by a snap hook having a pivoting latch.

5. The equine restraint system according to claim 1, further including a cord stop supported by a portion of said cord extending between said second pulley of said double pulley and said second end of said cord, said cord stop being releasably securable at a user selected location along said cord.

6. An equine restraint system comprising:

a cable having a first end and a second end;

a cord having a first end and a second end;

a double pulley having a first pulley and a second pulley, said second pulley being adjacent to and coaxial with said first pulley, said double pulley being attached to said cable proximate said second end of said cable; and a single pulley supported by said cord, said first end of said cable being attached to said first end of said cord, said cord being routed, in sequence, through said first pulley of said double pulley, said single pulley, and said second pulley of said double pulley, leaving a portion of said cord extending from said second pulley of said double pulley and terminating at said second end of said cord, whereby when said cable is positioned behind a horse's ears and when a portion of said cord located between said first end of said cable and said single pulley is placed under the horse's upper lip, pulling on a portion of said cord located between said second pulley of said double pulley and said second end of said cord causes pressure to be simultaneously applied to a region behind the horse's ears and a region under the horse's upper lip.

7. The equine restraint system according to claim 6, further including a handle provided at said second end of said cord.

8. The equine restraint system according to claim 6, further including a length of plastic tubing through which said cord passes, said length of plastic tubing being located between said first end of said cable and said single pulley, said plastic tubing preventing cuts and abrasions to the horse's upper lip and gum.

9. The equine restraint system according to claim 6, wherein said double pulley is releasably attached to said cable by a snap hook having a pivoting latch.

10. The equine restraint system according to claim 6, further including a cord stop supported by a portion of said cord extending between said second pulley of said double pulley and said second end of said cord, said cord stop being releasably securable at a user selected location along said cord.

* * * * *